United States Patent [19]

Lloyd et al.

[11] 4,285,605

[45] Aug. 25, 1981

[54] ESCAPEMENT MECHANISM AND BACKSPACE MECHANISM FOR A MOVING PAPER CARRIAGE TYPEWRITER HAVING DUAL PITCH CAPABILITY

[75] Inventors: Edward R. Lloyd; Raymond M. Marowski, both of Lexington, Ky.

[73] Assignee: International Business Machines Corporation, Armonk, N.Y.

[21] Appl. No.: 54,059

[22] Filed: Jul. 2, 1979

[51] Int. Cl.[3] ..... B41J 19/62

[52] U.S. Cl. ..... 400/310; 400/307.2; 400/311; 400/320; 400/331

[58] Field of Search ..... 400/307.2, 308, 309, 400/310, 311, 312, 320, 331

[56] References Cited

U.S. PATENT DOCUMENTS

| | | | |
|---|---|---|---|
| 844,289 | 2/1907 | Schuler | 400/307.2 |
| 2,268,867 | 1/1942 | Gabrielson et al. | 400/309 X |
| 3,346,086 | 10/1967 | Cralle et al. | 400/309 X |
| 3,482,671 | 12/1969 | Shattuck | 400/310 |
| 3,985,220 | 10/1976 | Rix et al. | 400/307.2 X |

FOREIGN PATENT DOCUMENTS

| | | | |
|---|---|---|---|
| 2611912 | 9/1977 | Fed. Rep. of Germany | 400/331 |
| 1436516 | 5/1976 | United Kingdom | 400/308 |

OTHER PUBLICATIONS

IBM Technical Disclosure Bulletin, "Integrated Forward and Backspace Mechanism," Miles et al., vol. 12, No. 12, May 1970, pp. 2189–2191.

IBM Technical Disclosure Bulletin, "Backspace for Dual-Pitch Escapement," Lloyd, vol. 22, No. 10, Mar. 1980, pp. 4774–4775.

*Primary Examiner*—Ernest T. Wright, Jr.

*Attorney, Agent, or Firm*—Laurence R. Letson

[57] ABSTRACT

A mechanism which will function to allow the escapement of the carriage of a typewriter in one of two predetermined escapement pitches and be capable of backspace operation from a single backspace input for both pitches regardless of which escapement pitch is selected. Escapement ratchets for the two selected pitches are combined, together with a backspace ratchet. Each of the escapement ratchets are engageable by an escapement pawl and the engagement of a pawl with a particular ratchet will determine the pitch within which the escapement system will function. A backspace ratchet is combined with the escapement ratchets and fixedly attached thereto to provide the backspace drive. The backspace ratchet is selectably engageable by the backspace pawl for causing rotation in the opposite direction of that normally utilized for escapement. All motion of the escapement ratchets or backspace ratchet is transmitted through a pinion mounted to the ratchet assembly and, in turn, is transmitted to the paper carriage rack.

3 Claims, 4 Drawing Figures

ESCAPEMENT MECHANISM AND BACKSPACE MECHANISM FOR A MOVING PAPER CARRIAGE TYPEWRITER HAVING DUAL PITCH CAPABILITY

BACKGROUND OF THE INVENTION

Moving paper carriage typewriters have been well known and well developed throughout the past. The escapement systems therein have typically used a moving and fixed dog arrangement to engage protruding stops on a ratchet wheel. The ratchet wheel has been fixed to a pinion for engagement with the paper carriage rack. With the advent of interchangeable type elements, such as are found on single element moving print carriage typewriters, the availability of dual pitch typewriters has become considerably more prevalent. It has been a desirable goal to implement a feasible and reliable dual pitch escapement system on moving carriage typewriters.

Techniques for implementing dual pitch escapement on moving print carriage typewriters differ substantially from that applicable to moving paper carriage typewriters and, as such, are not clearly adaptable for that purpose. Additionally, the requirement for a backspacing technique for moving paper carriage typewriters further creates difficulty in attempting to implement the moving carriage dual pitch system.

It is an object of this invention to backspace the paper carriage typewriter in such a manner that it may function properly and reliably regardless of which of two pitches the escapement system is operating in.

It is an additional object of this invention to select from the keyboard the increment of escapement through which the carriage of a moving carriage typewriter will displace upon the depression of any escaping key stroke.

It is a further object of this invention to reliably backspace the carriage regardless of the pitch from a single non-selectable keyboard initiated mechanical drive.

SUMMARY OF THE INVENTION

An escapement mechanism of the rack and pinion type is provided with a series of ratchets, one for each of two escapement pitches, and a backspace ratchet, all attached to the pinion in driving relationship. Escapement ratchets are each provided with an associated escapement pawl for purposes of releasing the ratchet for rotation in response to the spring biasing of the carriage rack against the pinion. Upon the restoring of the pawl to the ratchet, it arrests the ratchet at the next escapement tooth.

A backspace pawl is operatively driven by the backspacing cam to provide a counter rotating influence to the ratchet assembly through the backspace linkage. This reverse rotation of the ratchet assembly effects a reverse movement or backspacing movement of the pinion and rack. The escapement pawl will engage a preceding tooth in the desired pitch, thereby effecting stopping of the carriage at one escapement interval prior to the existing position. Thus, backspacing may be accomplished.

For a more detailed understanding of the invention and the accomplishment of the objects of this invention, together with the overcoming of shortcomings of the prior art may be had by referring to the attached drawing and the detailed specification to follow.

DRAWING

DETAILED DESCRIPTION

Figure 2:
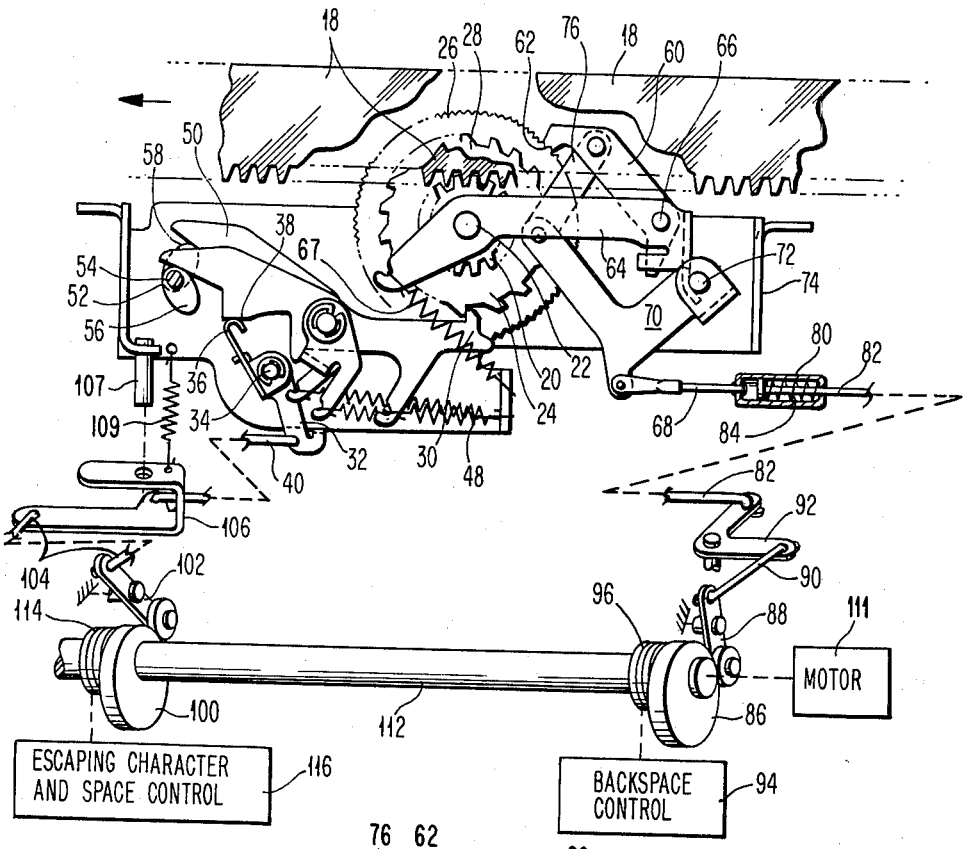
FIG. 2 illustrates the escapement mechanism removed from the typewriter but engaged with the paper carriage rack.

To accomplish escapement of the paper carriage 10 of typewriter 12 with respect thereto, and with respect to the single print element 8 positioned adjacent to the path of travel of the paper carriage 10 and platen 14, an escapement mechanism 16 is positioned beneath paper carriage 10 and engages a rack 18 rigidly attached to the paper carriage 10. Referring to FIG. 2, rack 18 is illustrated as partially broken away for visibility. Rack 18 is meshed with pinion 20 which rotates about shaft 22. Pinion 20, in a rotationally rigid configuration is attached to escapement ratchet 24, backspace ratchet 26 and escapement ratchet 28. Escapement ratchet 24 (by way of example) is configured with one tooth every eighteen degrees and represents a ten pitch escapement (ten print positions per inch).

Ratchet 28 (by way of example) is configured with one tooth every fifteen degrees, thereby representing a twelve pitch escapement (twelve print positions per inch). It should be understood that while the ten and twelve pitch escapement ratchets 24, 28 are described in this application, the selection of the particular pitch desired depends only upon the redesigning of the number of ratchet teeth around the circumference of the ratchet. Ratchets 24, 26 and 28 are all rigidly connected to rotate in unison and rigidly attached to pinion 20. Thus, any angular rotation of any ratchet 24, 26 or 28 will be directly translated to an equal angular rotation of pinion 20 and thus translation of rack 18.

Rack 18 is normally resiliently biased in the direction of the arrow. Thus, when escapement pawl 30 is engaging with ratchet 24, in the ten pitch mode, the teeth of ratchet 24 are resiliently biased against the tooth of pawl 30.

To effect translation of rack 18 in the escapement direction, pawl 30 is withdrawn from engagement with a tooth on ratchet 24 allowing the spring forces exerted on rack 18 and transmitted through pinion 20 to rotate the ratchet assembly 24, 26, 28.

Referring to FIG. 2, the withdrawal of escapement pawl 30 from the ratchet 24 is accomplished by means of the escapement member 32 being oscillated in a clockwise direction about its pivot 34. As it rotates clockwise, the upper caming surface 36 acts against cam surface 38 on pawl 30. As camming surface 36 acts against cam surface 38, pawl 30 will oscillate in a clockwise direction withdrawing its tooth from engagement with ratchet 24. Escapement member 32 is controlled by a link 40 which is moved by a bellcrank 106 in response to a cam driven follower 102. As the cam 100 drives follower 102, link 40 is moved leftward and as the cam follower 102 restores, link 40 is moved back to the right, thus withdrawing escapement member 32 and particularly caming surface 36 from beneath the caming surface 38 on pawl 30. As this occurs, spring member 48 acts to restore pawl 30 to engagement with the next succeding tooth on ratchet 24.

The operation of the twelve pitch pawl 50 is the same as that just described for pawl 30, with the exception that it engages and disengages from the teeth of ratchet 28.

Pawl 30 and pawl 50 may be respectively selected and the opposite one disengaged from its respective ratchet 24, 28 by pitch change cam member 52. Pitch change cam member 52 comprises a shaft 54 and two lobes or caming surfaces 56, 58 which respectively engage pawl 30 and 50.

With the rotation of shaft 54, the two lobes or caming surfaces 56, 58 will cause pawl 30 or pawl 50 to be disengaged from its respective ratchet 24, 28. The positioning of the cam surfaces 56, 58 on shaft 54 is such that both pawls 30, 50 are in a zone of engagement with the path of the teeth on ratchets 24 and 28 at one point during the pitch change. This insures that when the pawl 30, 50 previously engaged with its ratchet 24, 28 is removed that the spring bias on the carriage 10 and rack 18 will not be effective to move the carriage 10 past a point representing the next escapement position in the new pitch.

To accomplish backspace in the system disclosed, it is necessary to rotate the ratchet assembly comprising ratchets 24, 26 and 28 in a direction opposite that of the normal escapement rotation. It is also necessary to rotate the ratchet assembly 24, 26, 28 through an angular distance slightly in excess of 18° to insure that if the pitch being utilized is that of ten pitch, that the pawl 30 will be able to re-engage the teeth on ratchet 24 after the backspacing operation. Clearly, the rotation of the backspace ratchet 26 by slightly in excess of 18° by way of example will not be sufficient to cause a double backspacing of the twelve pitch ratchet 28 which, in this example, has teeth positioned every 15°. Such a repositioning would require a 30° rotation of the backspace ratchet 26.

Figure 3:
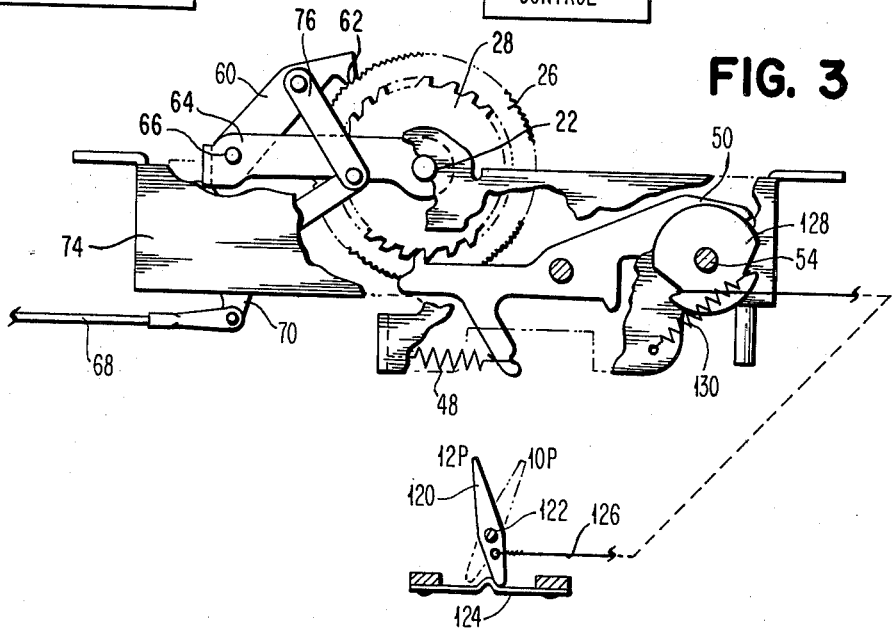
FIG. 3 illustrates the same mechanism from the reverse side.

To accomplish the backspacing of the backspace ratchet 26 or the reverse rotation of the ratchet assembly 24, 26, 28, a backspace pawl 60 and linkage arrangement is provided. Backspace pawl 60 is formed having a plurality of teeth 62 designed to engage the teeth on backspace ratchet 26. The teeth on backspace ratchet 26 in this example are spaced to subtend 3° of angle on the backspace ratchet 26 and the teeth 62 on backspace pawl 60 are formed in a complimentary dimension and shape. Backspace pawl 60 is carried on backspace bellcrank 64. Backspace bellcrank 64 is pivotally supported by shaft 22 about the axis of the ratchet assembly 24, 26, 28. Backspace bellcrank 64 is spring biased by a restore spring 67 acting on one end of the backspace bellcrank 64. The support provided by the backspace bellcrank 64 for backspace pawl 60 is a pivotal one at pivot 66. Backspace pawl 60 is illustrated in FIGS. 2 and 3 as engaged with the surface of ratchet 26. During normal escapement operations, teeth 62 are not engaged with the teeth of backspace ratchet 26 but clear them sufficient for free rotation of ratchet 26.

The engagement of teeth 62 on backspace pawl 60 is accomplished by the movement of link 68 in a rightward direction as illustrated in FIG. 2. The movement of link 68 rightward causes a bellcrank 70 to oscillate about its pivot point 72 supported by frame member 74, the direction of bellcrank movement being counterclockwise. The counterclockwise movement of bellcrank 70 exerts a tensile force on connecting link 76. Since link 76 is in turn connected to pawl 60, the initial movement of backspace link 68 will cause a counterclockwise rotation of backspace pawl 60 about its pivot 66 until such time as the teeth 62 engage the periphery of ratchet 26. At the time that teeth 62 engage ratchet 26, the further movement of link 76 and the pivoting of pawl 60 is prevented, effectively causing a rigid structure to be formed between bellcrank 64, pawl 60 and the ratchet wheel 26. Further movement of link 68 will be effective to further oscillate bellcrank 70 in a counterclockwise direction causing a transmission of force through link 76 to pawl 60 drawing pawl 60 downward in an arcuate path about pivot 22. With the teeth 62 of pawl 60 engaged with periphery of ratchet 26, the downward and clockwise movement of pawl 60 will cause ratchet 26 to move in a clockwise direction about its pivot 22. As the teeth of ratchets 24, 28 are moved in a clockwise direction in FIG. 2 by the movement of backspace ratchet 26, pawl 30 and 50 will, if engaged with one of the ratchets 24, 28, be cammed by their respective ratchets 24, 28 outward and then spring restored by spring 48 to re-engage the next preceding tooth on the ratchet 24, 28. That escapement pawl 30, 50 not previously engaged with its ratchet 24, 28 will continue to be held in an inoperative position.

With the configuration of bellcrank 70, bellcrank 64, link 76 and pawl 60, such that a pull on backspace link 68 will cause a rotation in a clockwise direction of the ratchet assembly 24, 26, 28 by an amount slightly in excess of 18°, the teeth of the escapement ratchets 24, 28 will be sufficiently moved in a clockwise direction to allow the engagement of a selected tooth on escapement pawls 30, 50 when the backspace engagement is disengaged. A leftward movement of backspace link 68 will cause the opposite movement of bellcrank 70 by releasing engagement with the teeth of the ratchet 26, by teeth 62 on backspace pawl 60, thereby allowing restore spring 67 to effectively restore bellcrank 64, together with its associated parts to its normal position with teeth 62 disengaged from the ratchet 26. The backspace link 68 is driven through a spring relief connection 80. The backspace link 68 and backspace drive link 82 are connected through the forces stored in and exerted by a compression spring 84. Thus, if rack 18 is positioned at its left margin travel limit and a backspace operation is initiated, backspace drive link 82 will compress spring 84 but will not cause any breakage in the chain of parts in response to backspace cam 86 driving follower 88. As follower 88 is driven during any backspace operation by cam 86, link 90 and bellcrank 92 are caused to respond as a result of the movement of follower 88, thereby driving backspace drive link 82. Backspace cam 86 is actuated from a backspace control 94 on the keyboard which acts upon a clutch member 96. Clutch member 96 may be one of any number of different types of clutches and is only shown schematically. The preferred clutching arrangement is that of a dog clutch with alternate forms of clutches, including a spring clutch, also usable. The implementation of these clutches is well known and further explanation is not needed.

Escapement is also controlled by cam 100 and its follower 102. Movement of the follower 102 in response to rotation of cam 100 will displace link 104 causing bellcrank 106, pivoted on shaft 107 and spring biased by spring 109, to oscillate pulling on escapement link 40.

Cam 100 may be clutched to shaft 112 which is continuously rotating under the drive motor 111, by clutch 114 under the influence of the escaping character and space control 116. Escaping character and space control 116 is a clutch control operable when any escaping character or space command is initiated at the keyboard 11. This can take many forms, one of which would be a universal bar being actuated by the depression of any key lever or space bar to initiate escapement.

Figure 1:
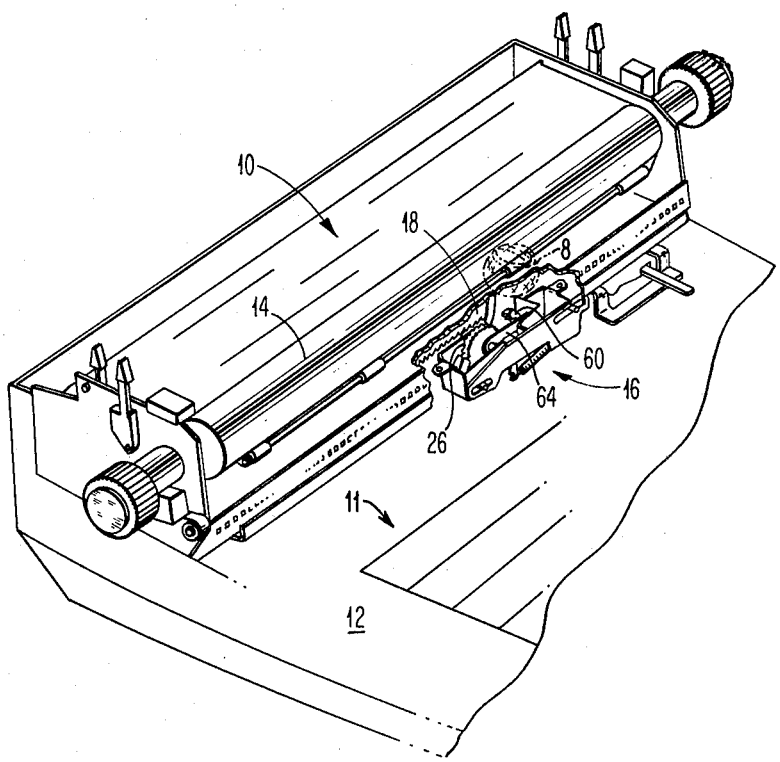
FIG. 1 shows the escapement mechanism in relationship to the paper carriage and the typewriter.
Figure 4:
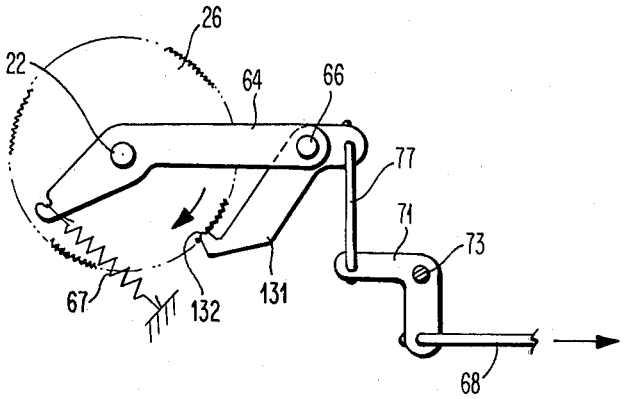
FIG. 4 illustrates an additional embodiment of the backspace pawl and its arrangement with other parts.

Referring to FIG. 4, there is illustrated an alternative backspace pawl arrangement wherein the backspace pawl 131 is provided with a single pawl tooth 132 to engage a single tooth in backspace ratchet 26. The backspace pawl bellcrank 64 supports the pawl 131 at pivot 66. The pawl 131 is connected to backspace drive bellcrank 71 by a link 77. Backspace drive bellcrank 71, pivoted on pivot 73, is then displaceable by a link 68. The single tooth 132 on pawl 131 insures a more reliable engagement with the teeth of ratchet 26.

The remaining elements of the assembly have been omitted from FIG. 4 for sake of clarity inasmuch as they are either substantially identical to or fully equivalent to those disclosed and may be interchanged therefor.

OPERATION

As a key lever is depressed at the keyboard 11 indicating the selection of a character for printing, the character requiring a normal escapement thereafter or a space being initiated from the keyboard 11, a clutch 114 is activated to couple, in driving relationship to shaft 112, cam 100. As the cam 100 rotates for a single cycle, follower 102 is displaced about its pivot axis in normal fashion, thereby pulling on link 104. The displacement of link 104 causes a movement of the bellcrank 106 thereby moving link 40 leftward. As link 40 is moved leftward, escapement member 32 acts to cam upward the escapement pawl 30 as shown in FIG. 2, thus withdrawing the tooth thereof from the corresponding engaged tooth on escapement ratchet 24 and allowing the ratchet assembly 24, 26, 28 to start to rotate. As cam follower 102 is allowed to fall down the reverse slope of cam 100 as it completes its rotation and restores to low dwell position, the chain of elements between cam 100 and escapement member 32 allow restoration of escapement member 32 to the position ilustrated, thereby allowing escapement pawl 30 to re-enter the next tooth on ratchet 24. The same sequence of operation occurs regardless of whether the pitch is ten pitch or twelve pitch.

The selection of the ten or twelve pitch mode of operation is accomplished by the pitch selection lever 120 located at the keyboard 11 and illustrated in FIG. 3. Pitch selection lever 120 is pivotally supported by the typewriter frame at pivot 122 and is detented by a flexible detent spring 124 to hold it in one of its two displaced positions. Connected to switch selection lever 120 is a Bowden cable 126 which in turn acts upon pulley 128 causing rotation thereof in response to the movement of lever 120. Pulley 128 is also spring biased to return to one position under the tension of the restore spring 130 when selection lever 120 permits. The displacement of lever 120 from the position indicated as 12P for twelve pitch to the position indicated by 10P for ten pitch will cause tension on the Bowden cable 126, thereby displacing the pulley 128 in a counterclockwise direction against the influence of restore spring 130 to present cam lobe 58 to escapement pawl 50 removing it from the twelve pitch ratchet 28 as illustrated in FIG. 2. If the pitch selection lever 120 is moved back to the 12P position, the Bowden cable 126 is relaxed and restore spring 130 will cause pulley 128 to rotate in a clockwise direction, thereby engaging lobe 56 with escapement pawl 30 and relieving escapement pawl 50 from engagement with lobe 58. As this occurs, the escapement pawl 50 is allowed to re-engage the escapement ratchet 28 before escapement pawl 30 is withdrawn from the escapement ratchet 24. As the pitch selection cam member 52 is caused to continue to rotate until selection lever 120 is in its fully detented position, then escapement pawl 30 will be fully withdrawn from engagement with ratchet 24 and the escapement system will then be conditioned for twelve pitch escapement.

To initiate backspacing operation regardless of the selection of pitch, the backspace control 94 at the keyboard 11 is operator activated, thereby engaging single revolution clutch 96 which, in turn, couples cam 86 to continuously rotating shaft 112. The rotation of cam 86 will displace cam follower 88 with that displacement being translated into a movement of link 82 acting against spring 84 causing a displacement of link 68. Link 68 acting through bellcrank 70 and link 76 will pull backspace pawl 60 such that the teeth thereon 62 will engage the teeth on the periphery of backspace ratchet 26 and will cause a clockwise rotation of the ratchet assembly 24, 26 28.

This clockwise rotation will cause a movement of rack 18 rightward as illustrated in FIG. 2 in response to the clockwise rotation of pinion 20 with the ratchet assembly 24, 26, 28. The throw of the backspace pawl 60 around pivot point 22 is designed to rotate the backspace ratchet 26 by an arcuate displacement in excess of 18° in the example discussed herein to insure that regardless of the pitch selected, the escapement pawls 30, 50 will have an ample opportunity to be re-positioned in front of the next preceding escapement tooth on the ratchet 24 or 28, whichever being effective, it being understood that the other escapement pawl is held in an inactive position by escapement selection cam member 52.

By utilizing a rack and pinion escapement system and a selectable pawl assembly, a dual escapement system may be implemented into moving paper carriage typewriters with the use of two predetermined dimension escapement ratchets. By combining a third ratchet, a backspace ratchet with the previous two, it is then possible to efficiently and reliably effect backspace from the same ratchet assembly by insuring that the throw of the pawls engaging the backspace ratchet is sufficient to reposition the ratchet assembly by an amount more than necessary to allow engagement of either escapement pawl with its respective ratchet teeth.

What is claimed is:

1. An escapement and backspace apparatus for a dual pitch typewriter having a carriage, a printing means, means for selecting characters on said printing means, said carriage associated with said typewriter to translate relative thereto:

escapement means for defining the positions of said carriage with respect to said typewriter and for moving said carriage through said positions in stepwise manner, in a selected one of a plurality of predetermined escapement pitches, said escapement means comprising, a plurality of escapement ratchets, each defining a separate escapement pitch, and a backspace ratchet, said ratchets associated to rotate together, the ratchet teeth on said backspace ratchet subtending an arc equal to the lowest common divisor of the angles subtended by the teeth on said escapement ratchets;

an escapement pawl operatively associated with each of said escapement ratchets, means for withdrawing said escapement pawls from said escapement ratchets and thereafter releasing said escapement pawls for re-entry into the next tooth of said escapement ratchets, operator controlled means for rendering all but one of said escapement pawls inoperative;

and a backspace pawl operative to engage said backspace ratchet and rotate said backspace ratchet in a backspacing direction by an arcuate increment greater than the arc subtended by the largest arc between teeth on said escapement ratchets.

2. A typewriter having an escapement wheel and escapement mechanism configured to selectively effect escapement in one of at least two different escapements, said escapement wheel and mechanism comprising a plurality of escapement ratchets and a backspace ratchet; means for selectively controlling the incremental rotation of said escapement wheel in response to keyboard originated movements in one of said escapements, backspace control means for effecting the reverse rotation of said escapement wheel, said backspace control means comprising a backspace pawl engageable with teeth on said backspace ratchet of said escapement wheel; a backspace control for operator operation operatively coupled to said backspace pawl, said backspace pawl moving through an arc around the center of rotation of said escapement wheel and through an arc at least equal to the largest angular arc subtended by any escapement tooth on said escapement ratchets and responsive to operation of said backspace control; said means for selectively controlling the incremental rotation of said escapement wheel comprises a plurality of escapement pawls, one for each of said escapement ratchets, said escapement pawls independently withdrawable from their respective escapement ratchets to render said escapement pawls ineffective to engage said respective escapement ratchets, means responsive to operator initiated control to effect said withdrawal, means for effecting withdrawal of one of said escapement pawls and releasing said one escapement pawl for reengagement with its respective escapement ratchet in response to keyboard operations by said operator, to permit rotation of said escapement wheel to effect escapement.

3. The typewriter of claim 2 wherein said teeth on said backspace ratchet subtend an arc equal to an arc subtended by the largest angle devisable into the angles subtended by the teeth of said escapement ratchets to yield a whole number.

* * * * *